United States Patent [19]

Ziegler et al.

[11] Patent Number: 5,052,166

[45] Date of Patent: Oct. 1, 1991

[54] METHOD AND APPARATUS FOR CONTINUOUS PACKAGE MAKING

[75] Inventors: Beda Ziegler; Ernst Wanner, both of Schaffhausen, Switzerland

[73] Assignee: Sig Schweizerische Industrie-Gesellschaft, Neuhausen am Rheinfall, Switzerland

[21] Appl. No.: 528,639

[22] Filed: May 24, 1990

[30] Foreign Application Priority Data

May 24, 1989 [CH] Switzerland ..... 1947/89

[51] Int. Cl.[5] ..... B65B 9/06; B65B 31/00

[52] U.S. Cl. ..... 53/433; 53/450; 53/443; 53/511; 53/542; 53/550

[58] Field of Search ..... 53/86, 88, 90, 110, 53/167, 209, 432, 433, 450, 463, 510, 511, 542, 548, 550, 443

[56] References Cited

U.S. PATENT DOCUMENTS

| | | | |
|---|---|---|---|
| 2,546,721 | 3/1951 | Campbell | 53/511 X |
| 2,919,990 | 1/1960 | Podlesak et al. | 53/550 X |
| 3,274,746 | 9/1966 | James et al. | 53/550 X |
| 3,402,524 | 9/1968 | Griner | 53/550 X |
| 3,995,407 | 12/1976 | Segale et al. | 53/511 |
| 4,170,863 | 10/1979 | Schwanz | 53/511 |
| 4,272,944 | 6/1981 | Suga | 53/550 |
| 4,642,969 | 2/1987 | Johnson | 53/433 |

FOREIGN PATENT DOCUMENTS

| | | | |
|---|---|---|---|
| 12800658 | 8/1978 | Fed. Rep. of Germany . | |
| 8003993 | 2/1982 | Netherlands | 53/511 |
| 376047 | 4/1964 | Switzerland | 53/550 |
| 376047 | 4/1964 | Switzerland | 53/550 |
| 1444277 | 7/1976 | United Kingdom . | |

*Primary Examiner*—John Sipos

*Attorney, Agent, or Firm*—Spencer & Frank

[57] ABSTRACT

A method of continuously making packages from groups of stacked items includes the steps of advancing consecutive groups of flat, edgewise standing, stacked items on a conveyor while supporting each item group by holders engaging each article group; during the advancing step, wrapping a wrapper sheet about an item group by a wrapper folding device, whereby the wrapper sheet supports and holds together the items in consecutive item groups; removing the holders from a just-wrapped article group; drawing the wrapper sheet, together with an item group wrapped in the wrapper sheet for conveying the item groups after the holders are removed therefrom; and withdrawing air from the wrapper sheet at a suction location where at least a partial wrapping has been completed, for generating a vacuum inside the wrapper sheet for causing the wrapper sheet to be pressed against edges of items in wrapped item groups downstream of the suction location.

11 Claims, 3 Drawing Sheets

METHOD AND APPARATUS FOR CONTINUOUS PACKAGE MAKING

CROSS REFERENCE TO RELATED APPLICATION

This application claims the priority of Swiss Application No. 1947/89-3 filed May 24, 1989, which is incorporated herein by reference.

BACKGROUND OF THE INVENTION

This invention relates to a method and an apparatus for continuously producing packages from groups of edgewise standing articles. The package comprises a sleeve which is wrapped about the article group and which has a longitudinal fin seam and two transverse fin seams.

In the continuous packaging of flat confectionery products such as disc or wafer-like biscuits, crackers or cookies, frequently between a packaging sleeve folding device and a transverse sleeve heating apparatus product safety arrangements such as belts, chains with carriers or pressing members engage the article groups from above or at the ends in the spacing between the groups. Such product safety arrangements which may contact the wrapping sleeve in a soft or hard manner, for example, with the intermediary of foam rubber or leaf springs are designed in accordance with product dimensions and tolerances. Thus, for each new batch of different product dimensions an appropriate safety arrangement has to stand by for replacement with the old devices. Such a procedure involves significant expenses: in particular, difficulties are encountered and a reduction of the operational safety occurs in case of large product tolerances which, however, are desirable by themselves.

Packing machines of the above-outlined type on occasion also have suction devices which are arranged downstream of the sleeve feeding device and/or are situated in the zone of the transverse heating devices in order to prevent a bloating of the packages or to make possible an improved transverse seal to thus obtain pinch folds which are aesthetically more pleasing. These arrangements, however, do not eliminate the above-noted disadvantages.

SUMMARY OF THE INVENTION

It is an object of the invention to provide an improved method and apparatus of the above-outlined type from which the discussed disadvantages are eliminated.

This object and others to become apparent as the specification progresses, are accomplished by the invention, according to which, briefly stated, the method of continuously making packages from groups of stacked items includes the steps of advancing consecutive groups of flat, edgewise standing, stacked items on a conveyor while supporting each item group by holders engaging each article group; during the advancing step, wrapping a wrapper sheet about an item group by a wrapper folding device, whereby the wrapper sheet supports and holds together the items in consecutive item groups; removing the holders from a just-wrapped article group; drawing the wrapper sheet, together with an item group wrapped in the wrapper sheet for conveying the item groups after the holders are removed therefrom; and withdrawing air from the wrapper sheet at a suction location where at least a partial wrapping has been completed, for generating a vacuum inside the wrapper sheet for causing the wrapper sheet to be pressed against edges of items in wrapped item groups downstream of the suction location.

DESCRIPTION OF THE PREFERRED EMBODIMENT

Figure 1:
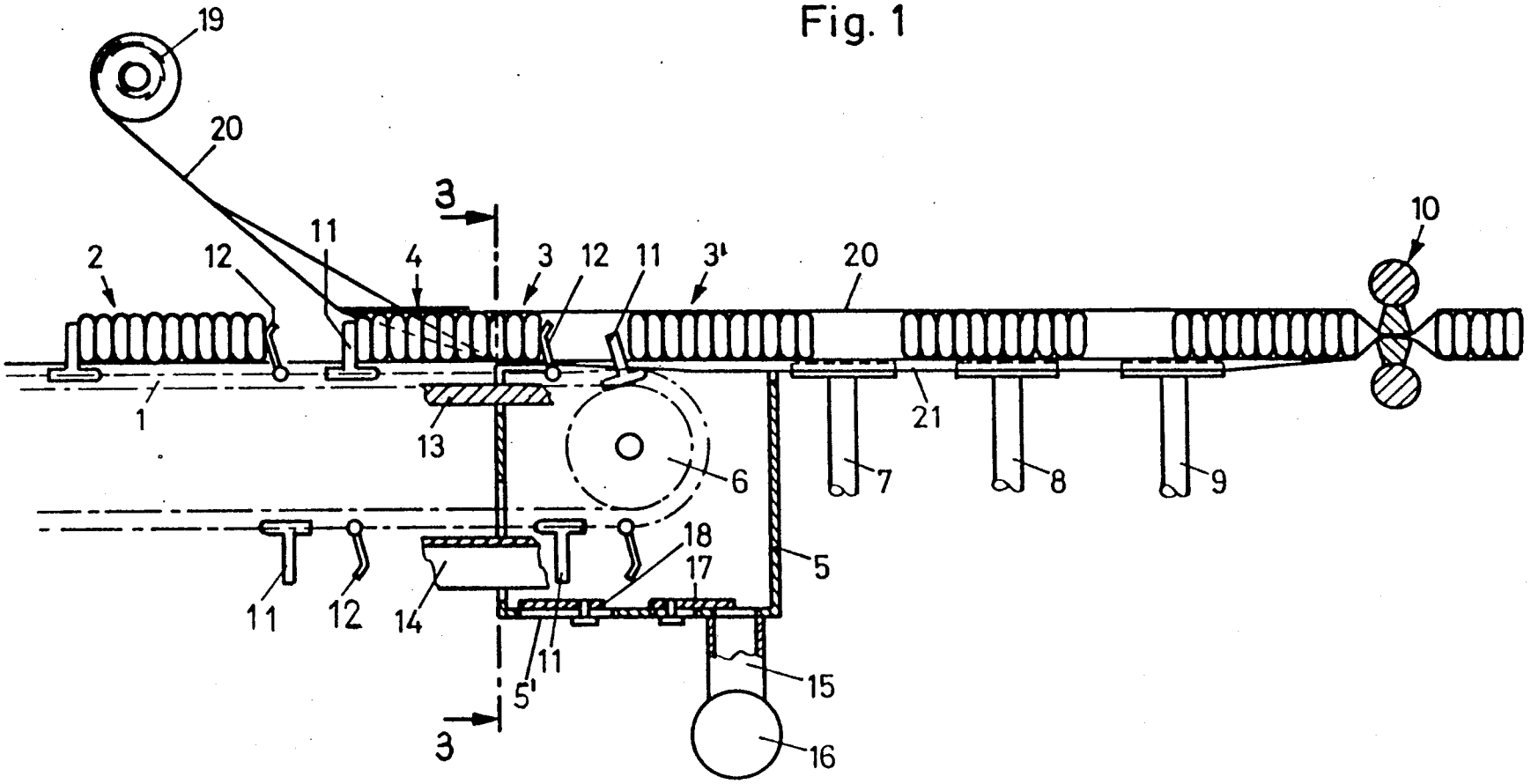
FIG. 1 is a schematic sectional side elevational view of a preferred embodiment of the invention.

Turning to FIG. 1, the apparatus shown therein has a conveyor chain 1 on which two spaced stacks 2 and 3 are advanced, each formed of edgewise standing confectionery items. The stack 3 is partially situated in a wrapper sleeve folding device or folding box 4. Downstream of the folding box 4, as viewed in the direction of article advance, and underneath the conveying plane, a suction chamber 5 is located which accommodates the end wheel 6 for the conveyor chain 1. Downstream of the suction chamber 5 there are arranged a withdrawing roller 7, two electrically heated longitudinal sealing rollers 9 and a transverse sealing roller 10 which engage the wrapper sheet 20 as will be described later. On the conveyor chain 1 there are spacedly mounted item group holders formed of carrier members 11 as well as retaining fingers 12. The conveyor chain 1 which is supported on an upper guide 13 and a lower guide 14 enters the upper portion of the suction chamber 5 and after travelling about the end roller 6 exits therefrom at a lower portion thereof. The inside of the suotion chamber 5 is in communication through a suction channel 15 with an exhaust fan 16 generating a vacuum in the suction chamber 5. The cross-sectional passage area of the suction channel I5 may be gradually varied by a displaceable throttle plate 17. The suction chamber 5 further has an opening 5' which is in communication with the ambient atmosphere and whose area also may be varied by a slidable throttle plate 18. The apparatus further includes a support for a wrapper sheet reel 19 from which the wrapper sheet 20 is pulled for making the packages.

Figure 2:
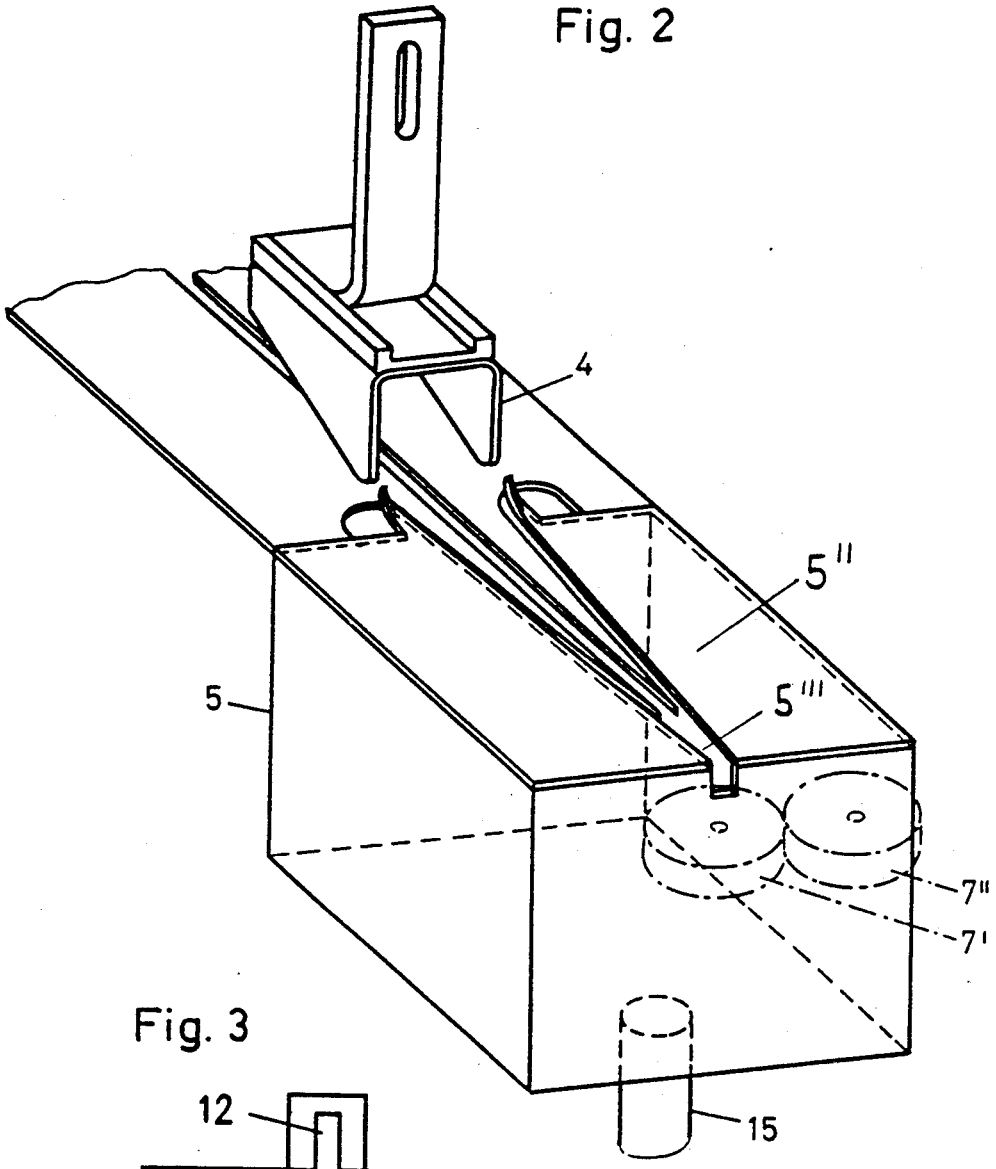
FIG. 2 is a perspective view of an enlarged detail of FIG. 1.

In FIG. 2 the folding box 4, the suction chamber 5 together with the suction channel 15 and two rollers 7' and 7'' of the withdrawing roller assembly 7 are schematically illustrated. The top wall 5'' constituting the roof of the suction chamber 5 has a slot 5''' through which ambient air is drawn in. The upper face of the top wall 5'' lies in the item conveying plane.

Figure 3:
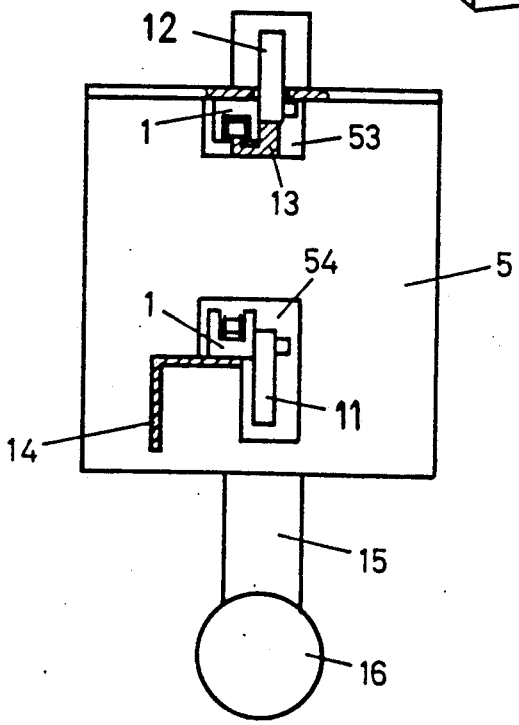
FIG. 3 is a sectional view taken along line III—III of FIG. 1.

In FIG. 3, the suction chamber 5, the suction channel 15 and the exhaust fan 16 are shown from the rear. FIG. 3 also shows the oonveyor chain 1, a retaining or withholding finger 12 and a carrier 11 and there are further shown the upper and lower chain support guides 13 and I4. The conVeyor chain 1 enters into the suction chamber 5 through a chamber opening 53 and exits therefrom through a chamber opening 54.

In the description which follows, the operation of the above-described apparatus will be set forth.

The groups stacked in an edgewise upstanding orientation between a respective carrier 11 and a respective retaining finger 12 are conveyed by the transport chain 1 to the folding box 4. In the folding box 4 the wrapper sheet 20 is, in a manner known by itself, wrapped as a sleeve about the items to be packaged and, as a result of this operation, on the underside a projecting longitudinal fin 21 is formed which projects downwardly through the slot 5''' and which is grasped by the driven rolls 7, 8 and 9 each of which may, for example, comprise a roller pair such as shown in FIG. 2 at 7', 7'', for further advancing the sleeve. At the same time, the fin 21 is sealed by the sealing rollers 8 and 9. The rolls 7, 8 and 9 are thus also acting as conveying means, since they advance—by pulling the wrapper sheet 20—the item groups wrapped in the sheet 20. The sleeve 20 thereafter arrives, with the enclosed articles, in the zone of the transverse sealing roll 10 which produces a transversal seal for sealing the ends of each package.

Figure 4:
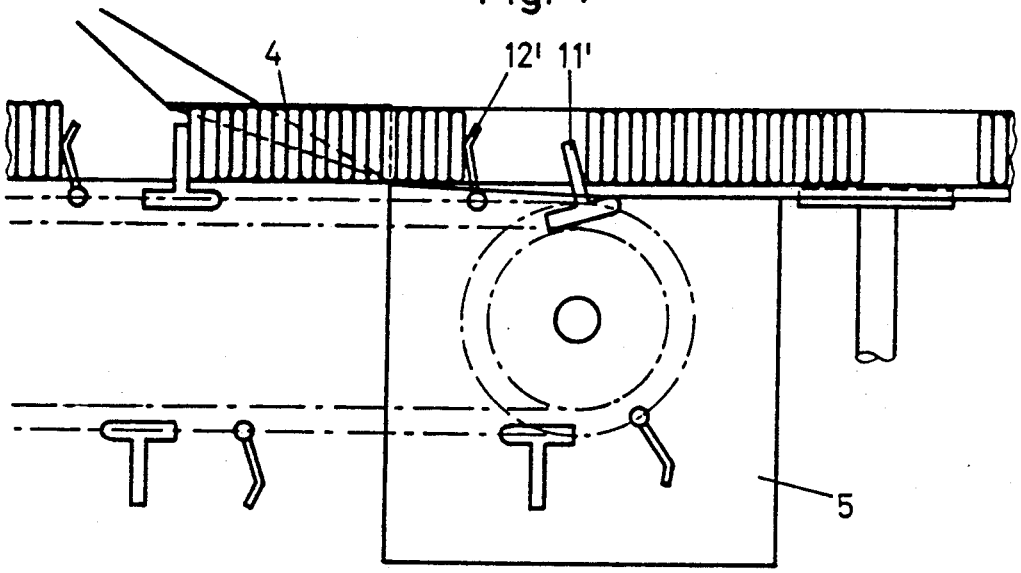
FIGS. 4, 5 and 6 are schematic side elevational views of the preferred embodiment depicting different sequential operational positions.
Figure 5:
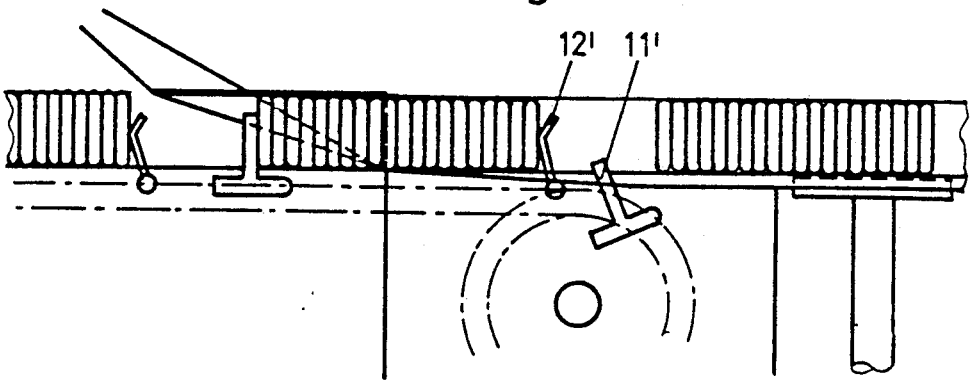
Figure 6:
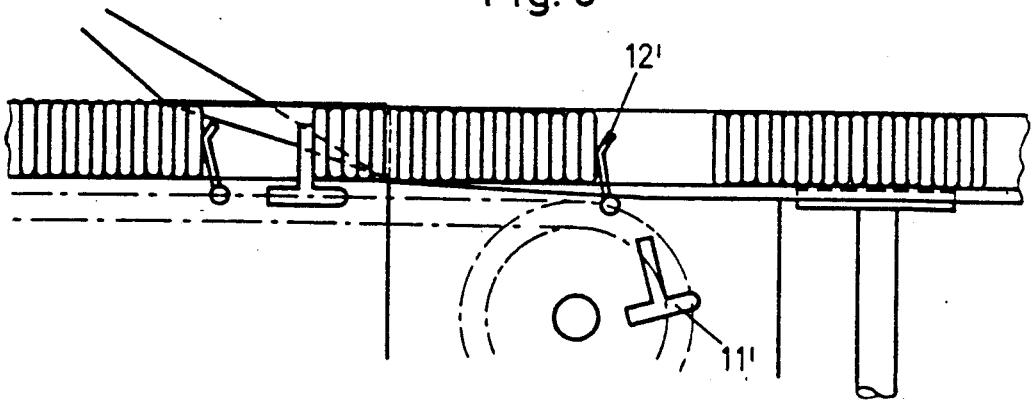

Thus, the articles are conveyed by the conveyor chain 1 only to approximately the mid zone of the suction chamber 5 where each carrier 11 and each retaining finger 12 execute a tilting motion as illustrated for one and the same carrier 11' and retaining finger 12' in the sequential FIGS. 4, 5 and 6. In the suction chamber 5 the exhaust fan 16 generates a vacuum which propagates through the entire inner space of the wrapper sleeve, since the wrapper sleeve 20 is downwardly still open as it travels, with the items wrapped in it, over the vacuum chamber 5. By virtue of the vacuum within the wrapper sheet 20, the wrapper is drawn against the item edges, thus providing an improved support for the item groups. The vacuum undergoes sudden fluctuations caused by the passage of the retaining fingers 12 and the carriers 11 through the apertures 53 and 54 because the effective opening area of the apertures 53 and 54 is reduced by the obturating effect of the carriers 11 and retaining fingers 12. Consequently, the exhaust fan 16 has to be sufficiently powerful to draw air which flows in greater or smaller quantities through the apertures 53 and 54. Expediently, an oversized exhaust fan 6 is used whose vacuum effect may be reduced by the slidable throttle 17 and 18.

The above-noted sudden vacuum fluctuations cause in certain wrapper materials slight and generally not visible permanent deformations about the edges of the articles, whereby the edgewise standing articles are prevented from toppling when, after their passage through the folding box 4, they are no longer held by the carriers and the retaining fingers 11 and 12, but are supported only by the wrapper sheet 20.

The downstream end of the folding box 4 and the upstream end of the suction chamber 5 may be in vertical alignment, or may be vertically offset as shown in FIG. 1. In case a retaining finger 12 enters into the suction chamber 5 through the opening 53 which thus lies in the plane III—III, there is obtained a first momentary vacuum surge which affects particularly the leading item of the group 3 and the trailing item of the previous group 3' while both items are still held by the respective retaining finger 12 (for the group 3) and the carrier 11 (for the group 3') A second momentary vacuum surge occurs as a carrier 11 passes through the lower chamber aperture 54, further enhancing the effect described above. A further support of the described effect may be achieved by providing for a simultaneous passage of the retaining fingers and/or the carriers through the openings 53 and 54 at a moment in which the leading item of the group 3 and the trailing item of the previous group 3' are still retained. It has been found, however, that such an additional support is not required in all types of packing material. The vacuum may be between 0.03 to 0.1 mWS (approximately 300–1,000 Pascal) without, however, these limits being firm.

For other wrapping materials which do not undergo the above-noted permanent deformations, the throttle plates 18 and/or 17 may be set such that the vacuum changes are less than ±0.01 mWS. It is also feasible to automatically control the plates 18 and/or 17 in such a manner in synchronism with the passages of the revolving carriers 11 and retaining fingers 12 through the chamber apertures 53 and 54 that the vacuum in the suction chamber 5 undergoes only small fluctuations.

It will be understood that the above description of the present invention is susceptible to various modifications, changes and adaptations, and the same are intended to be comprehended within the meaning and range of equivalents of the appended claims.

What is claimed is:

1. In a method of continuously making packages from groups of stacked items, comprising the following steps:

(a) advancing consecutive groups of flat, edgewise standing, stacked items on a conveyor;

(b) during the advancing step, supporting and holding together each item group by holders engaging each article group;

(c) during the advancing and supporting steps, wrapping a warpper sheet about an item group by a wrapper folding device, whereby the wrapper sheet supports and holds together the items in consecutive item groups jointly with the holders;

(d) subsequent to the beginning of the wrapping step, removing the holders from an at least partially wrapped article group;

(e) drawing the wrapper sheet, together with an item group wrapped in the wrapper sheet, by pulling means situated downstream of said conveyor as viewed in the direction of advancement of the items, for conveying the item groups subsequent to the removing step; and (f) withdrawing air from the wrapper sheet at a suction location where at least a partial wrapping performed during the wrapping step has been completed and where the removign step is being performed, for generating a vacuum inside the wrapper sheet for causing the wrapper sheet to be pressed against edges of items in wrapped item groups downstream of said suction location.

2. A method as defined in claim 1, wherein said vacuum is approximately between 300 and 1,000 Pascal.

3. An apparatus for continuouatly making packages from groups of stacked items, comprising (a) a driven conveyor having a conveyor face for supporting and advancing consecutive groups of flat, edgewise standing, stacked items; said conveyor face defining a conveying plane; said conveyor having a downstream end zone as viewed in a direction of item advance;

(b) a plurality of spaced holders mounted onthe conveyor for circulating therewith; each item group being situated between one of the holders engaging a leading item of the group and another holder engaging a trailing item of the group;

(c) wrapping means situated in said end zone on a first side of said conveying plane for wrapping a wrapper sheet about each item group passing through said end zone and while being engaged by said one and said other holder;

(d) removign means for moving said one and said other holder sequentially away from each item group at a location where each item group is in an at least partially wrapped state;

(e) means defining a suction chamber situated on a second, opposite side of said conveying plane and suction generating means connected to said suction chamber for generating a vacuum therein; said suction chamber having an opening situated generally in said conveying plane for drawing air from the wrapper sheet wrapped about the article groups, whereby the wrapper sheet is drawn against edges of items in the wrapped article groups; said opening overlapping a location where the holders are moved away from the item groups; and (f) drawing means situated downstream of said suction chamber for pulling the wrapper in a conveying direction together with consecutive item groups wrapped therein.

4. An apparatus as defined in claim 3, further wherein said means defining a suction chamber has an entrance aperture and an exit aperture through which said holders pass.

5. An apparatus as defined in claim 4, wherein said driven conveyor comprises an endless member carrying said holders and an end wheel supported within said suction chamber; said endless member being trained about said end wheel.

6. An apparatus as defined in claim 4, wherein said means defining said suction chamber has an upstream end as viewed in said direction of item advance and said wrapping means has a downstream end spaced in an upstream direction from said upstream end.

7. An apparatus as defined in claim 4, further comprising a suction channel connecting said suction chamber with said suction generating means; and adjustable throttle means for varying a cross-sectional area of said suction channel.

8. An apparatus as defined in claim 4, further wherein said means defining a suction chamber comprises an air inlet opening; further comprising an adjustable throttle means for varying a flow-passage area of said air inlet opening.

9. An apparatus for continuously making packages from groups of stacked items, comprising (a) a driven conveyor having a conveyor face for supporting and advancing consecutive groups of flat, edgewise standing, stacked items; said conveyor face defining a conveying plane; said conveyor having a downstream end zone as viewed in a direction of item advance; said conveyor further comprising an endless member and an end wheel about which said endless member is trained;

(b) a plurality of spaced holders mounted on the endless member for circulating therewith; each item group being situated between one of the holders engaging a leading item of the group and another holder engaging a trailing item of the group;

(c) wrapping means situated in said end zone on a first side of said conveying plane for wrapping a wrapper sheet about each item group passing through said end zone;

(d) means defining a suction chamber situated on a second, opposite side of said conveying plane and suction generating means connected to said suction chamber for generating a vacuum therein; said suction chamber having an opening situated generally in said conveying plane for drawing air from the wrapper sheet wrapped about the article groups, whereby the wrapper sheet is drawn against edges of items in the wrapped article groups; said suction chamber having entrance and exit apertures through which said holders pass; said end wheel being supported within said suction chamber; and (e) drawing means situated downstream of said suction chamber for pulling the wrapper in a conveying direction together with consecutive item groups wrapped therein.

10. An apparatus for continuously making packages from groups of stacked items, comprising (a) a driven conveyor having a conveyor face for supporting and advancing consecutive groups of flat, edgewise standing, stacked items; said conveyog face defining a conveying plane; said conveyor having a downstream end zone as viewed in a direction of item advance;

(b) a plurality of spaced holders mounted on the conveyor for circulating therewith; each item group being situated between one of the holders engaging a leading item of the group and another holder engaging a trailing item of the group;

(c) wrapping means situated in said end zone on a first side of said conveying plane for wrapping a wrapper sheet about each item group passing through said end zone;

(d) means defining a suction chamber situated on a second, opposite side of said conveying plane and suction generating means connected to said suction chamber for generating a vacuum therein; said suction chamber having an opening situated generally in said conveying plane for drawing air from the wrapper sheet wrapped about the article gruops, whereby the wrapper sheet is drawn against edges of items in the wrapped article groups;

(e) a suction channel connecting said suction chamber with said suction generating means;

(f) adjustable throttle means for varying a cross-sectional area of said suction channel; and (g) drawing means situated downstream of said suction chamber for pulling the wrapper in a conveying direction together wtih consecutive item groups wrapped therein.

11. An apparatus for continuously making packages from groups of stacked items, comprising (a) a driven conveyor having a conveyor face for supporting and advancing consecutive groups of flat, edgewise standing, stacked items; said conveyor face defining a conveying plane; said conveyor having a downstream end zone as viewed in a direction of item advance;

(b) a plurality of spaced holders mounted on the conveyor for circulating therewith; each item group being situated between one of the holders engaging a leading item of the gorup and another holder engaging a trailing item of the group;

(c) wrapping means situated in said end zone on a first side of said conveying plane for wrapping a wrapper sheet about each item group passing through said end zone;

(c) means defining a suction chamber situated on a second, opposite side of said conveying plane and suction generating means connected to said suction chamber for generating a vacuum therein; said suction chamber having an opening situated generally in said conveying plane for drawing air from the wrapper sheet wrapped about the article groups, whereby the wrapper sheet is drawn against edges of items in the wrapped article groups; said suction chamber further comprising an air inlet opening;

(e) an adjustable throttle means for varying a flow-passage area of said air inlet opening; and (f) drawing means situated downstream of said suction chamber for pulling the wrapper in a conveying direction together with consecutive item groups wrapped therein.

* * * * *